US005216765A

United States Patent [19]

Paterson et al.

[11] Patent Number: 5,216,765

[45] Date of Patent: Jun. 8, 1993

[54] GRAVITY FED EYE/FACE WASH

[75] Inventors: Graham H. Paterson, Wilmington, Del.; Barbara MacKenzie, Des Ormeaux, Canada; Frederick M. Kappel; Bernard K. Bedwell, both of Wilmington, Del.

[73] Assignee: Speakman Company, Wilmington, Del.

[21] Appl. No.: 770,590

[22] Filed: Oct. 3, 1991

[51] Int. Cl.[5] ..... A61H 33/00

[52] U.S. Cl. ..... 4/620; 4/624

[58] Field of Search ..... 4/620, 624; 239/16, 239/24, 25, 26, 27, 152, 373, 376, 379, 550, 600; 137/862, 876, 887; 604/294, 295, 300, 301, 302

[56] References Cited

U.S. PATENT DOCUMENTS

| | | | |
|---|---|---|---|
| 2,986,340 | 5/1961 | Webb | 239/600 X |
| 2,999,249 | 9/1961 | Logan et al. | 4/620 X |
| 3,081,040 | 3/1963 | Hartmann | 239/600 X |
| 3,106,722 | 10/1963 | Logan et al. | 4/620 X |
| 3,410,487 | 11/1968 | Hyde | 239/26 |
| 3,413,660 | 12/1968 | Lagarelli et al. | 4/620 |
| 3,579,656 | 3/1971 | Guarrasi | 4/626 |
| 3,602,436 | 8/1971 | Wright | 239/16 X |
| 3,925,829 | 12/1975 | Bost | 4/620 X |
| 4,012,798 | 3/1977 | Liautaud | 4/620 |
| 4,363,146 | 12/1982 | Liautaud | 4/620 |
| 4,493,119 | 1/1985 | Baumann | 4/620 |
| 4,641,384 | 2/1987 | Landsberger et al. | 4/620 |
| 4,675,924 | 6/1987 | Allison et al. | 4/620 |
| 4,688,276 | 8/1987 | Allison et al. | 4/620 |
| 4,881,283 | 11/1989 | Liantaud | 4/620 |
| 4,898,330 | 2/1990 | Betchan | 239/373 X |
| 4,939,800 | 7/1990 | Fiorentino et al. | 4/620 |

OTHER PUBLICATIONS

Journal of Chemical Education, "A Simple and Inexpensive Eye Irrigation Fountain", Dec. 1975, p. 810, vol. 52, No. 12.

*Primary Examiner*—William A. Cuchlinski, Jr.
*Assistant Examiner*—John L. Beres
*Attorney, Agent, or Firm*—Connolly & Hutz

[57] ABSTRACT

A portable gravity fed eye/face wash comprises a water container having a fill opening and a closure cap at the upper end of the container. A recessed storage cavity on a front wall of the container accommodates a spray head assembly secured to the container for movement between an outwardly extending operative position and an upwardly extending inoperative and stored position. The spray head assembly includes a pair of spaced apart L-shaped elongate conduit members with upwardly disposed outer legs angled toward one another. When the spray head assembly is in its outwardly directed operative position water flows from the container through the spray head assembly and out of spray heads at the ends of the outer legs of the L-shaped elongate conduit members. Alternatively, when the spray head assembly is oriented upwardly into the storage cavity in the front wall of the container the flow of water is terminated.

17 Claims, 7 Drawing Sheets

60
62
63
64
66
70
72
74
76
78
80
82
84
86
88
100
102
104
106
108
120
122
124

GRAVITY FED EYE/FACE WASH

BACKGROUND OF THE INVENTION

The present invention relates to an emergency eye/-face wash, and more particularly to a portable gravity fed eye/face wash for flushing harmful material away from the eyes and face.

Numerous eye and face washing stations have been proposed over the years for administering to the needs of workers. For the most part, these stations are in wide use in factories and laboratories as well as other locations where the danger of injury to the eyes and face exists due to the splashing of chemicals, dust, dirt and other irritants which may be present in the work environment.

Stationary systems are usually connected to regular plant plumbing, and extended periods of non-use of these systems often causes drying of the nozzle and valve structures. Infrequent use also causes scale and corrosion to build on interior parts which can increase injury if sprayed into the eyes. Moreover, these drying effects and scale deposits often render stationary systems ineffective for their intended purpose.

Portable systems have a distinct advantage in that they can be transported to locations where eye/face wash systems are most needed. As conditions change these systems may be moved from one location to the next.

Although numerous portable systems have been proposed, they are often difficult to transport, particularly because of the water weight associated with them. Properly constructed handles and their locations are therefore critical. Moreover, at times gravity alone is insufficient to supply the necessary water volume to the spray heads in order to achieve the required flushing action. It is also important that the spray heads be protected during extended periods of non-use. These heads must be free of contamination when they are needed in an emergency.

SUMMARY OF THE INVENTION

Accordingly, one of the objects of the present invention is a portable gravity fed eye/face wash which is simple in construction but extremely efficient in flushing the eye and face areas with a continuous stream of water.

Another object of the present invention is a portable gravity fed shower which is simple in construction and highly efficient in providing a downwardly directed flow of water.

Still another object of the present invention is a portable gravity fed wash wherein hand held spray heads are easily and efficiently manipulated to direct a flow of water to a desired location.

In accordance with the present invention, a portable gravity fed eye/face wash comprises a water container having a fill opening and a closure cap at an upper end of the container. A recessed storage cavity is provided on a front wall of the container, and a spray head assembly is secured to the water container within the recessed storage cavity. A rotatable valve mechanism is positioned between the water container and the spray head assembly, the valve mechanism having open and closed positions approximately 90° apart for regulating water flow from the container to the spray head assembly.

Preferably the spray head assembly includes a pair of spaced apart L-shaped elongate conduit members each having an inner leg generally parallel to the other inner leg. Specifically, one end of each inner leg is connected to the valve mechanism. Additionally, each L-shaped elongate member has a relatively shorter outer leg connected to the inner leg at an approximate right angle thereto. The outer legs are upwardly disposed and angled toward one another and a spray head is connected to each outer leg.

The spray head assembly has an operative position with the L-shaped elongated conduit members extending outwardly away from the container and the valve mechanism open with water flowing to the spray heads. In its inoperative position the L-shaped elongate conduit members of the spray head assembly are upwardly oriented into the storage cavity and the valve mechanism is closed with no water flowing from the spray heads.

Preferably, the water container has opposite side walls, a rear wall and a front wall, and recessed hand holds are provided in each of the side and rear walls. Additionally, the recessed storage cavity in the front wall of the container may include a rearwardly recessed portion which functions as a hand hold and also as a recess for receiving the outer legs of the L-shaped elongate members and the spray heads attached thereto when the spray head assembly is upwardly oriented into the storage cavity to its inoperative and stored position.

The spray head at the end of each of the L-shaped elongate conduit members may comprise a spray head base releasably connected to the outer leg and a spray head cap releasably connected to the spray head base.

Preferably the spray head base includes a plurality of spaced apart undercuts arranged in a circular pattern. The spray head cap includes a plurality of equally spaced apart lugs arranged in a similar circular pattern for locking engagement with the undercuts. The lugs and undercuts may include cooperating inclined surfaces in engagement with one another to force the base and cap tightly together.

Preferably each spray cap includes a plurality of spray openings equally spaced apart and arranged in a circular pattern. Moreover, each of the spray openings may comprise a frusto-conical passageway with the small end thereof opening in an outward direction.

The valve mechanism preferably includes a valve body fixed to the water container and a valve spindle rotatably mounted within the valve body. Valve outlet ends are secured to the ends of the valve spindle for rotation therewith, preferably by a splined connection between external splines on the ends of the valve spindle and internal mating grooves on the valve outlet ends. The valve outlet ends are connected to the inner legs of the L-shaped elongated conduit members. A water inlet is provided in the valve body and a similar sized opening in the valve spindle is in alignment with the water inlet in the valve body when the spray head assembly is in its operative position. When the spray head assembly is in its inoperative and stored position the inlet in the valve body and the opening in the valve spindle are out of alignment and there is no water flow. A seal is secured to the valve body for sealing the opening in the valve spindle when the spray head assembly is in its inoperative and stored position.

The portable gravity fed eye/face wash of the present invention preferably includes a fluid level indicator in the water container for determining and indicating the level of water in the container. Additionally, an air pump may be connected to the water container for pressurizing the container to thereby assist the gravitation forces in flowing water to the spray head assembly when that assembly is in its operative position. The pump is particularly useful when the water level in the container is low.

In another embodiment of the invention the spray head assembly is oriented 180° to provide a gravity fed shower. The outer legs of the L-shaped elongate conduit members are then downwardly disposed and at an angle toward one another. Otherwise, the shower is the same as the portable gravity fed eye/face wash.

Still another embodiment of the invention comprising a similar water container to which hand held spray heads are releasably secured by flexible tubing connected between the container and the spray devices. An operator on each spray device controls the flow of water therefrom.

BRIEF DESCRIPTION OF THE DRAWINGS

Novel features and advantages of the present invention in addition to those mentioned above will become apparent to those of ordinary skill in the art from a reading of the following detailed description in conjunction with the accompanying drawings wherein similar reference characters refer to similar parts and in which.

DETAILED DESCRIPTION OF THE INVENTION

Figure 3:
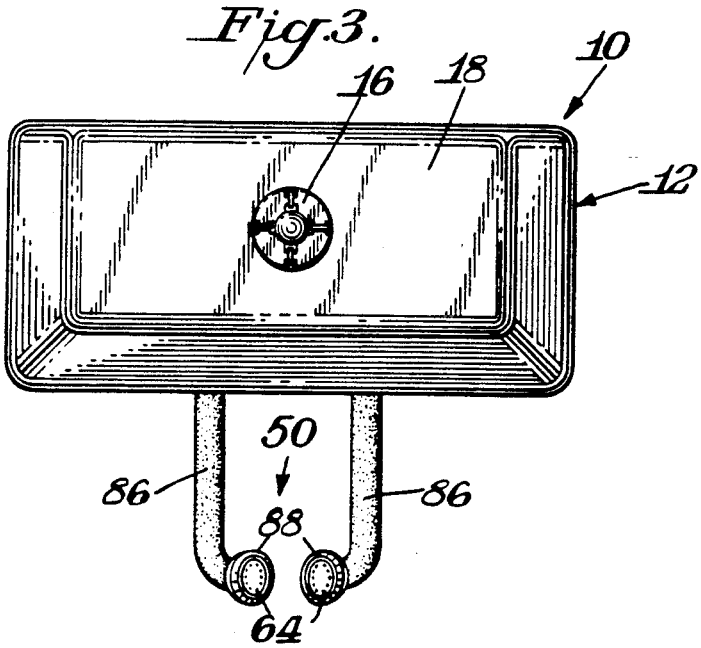
FIG. 3 is a top plan view of the gravity fed eye/face wash shown in FIGS. 1-2.

Referring in more particularity to the drawings, FIGS. 1-5 illustrate a portable gravity fed eye/face wash 10 in its operative position. The eye/face wash comprises a water container 12 having a fill opening 14 and a closure cap 16 at an upper end wall 18 of the container. Container 12 also has opposite side walls 20,22, a rear wall 24, a front wall 26, and a bottom wall 28. Although the container may be fabricated from a variety of materials utilizing different techniques, it is preferred that the container be molded of thermoplastic high density polyethylene. In addition to the water within the container, eye wash solution may be added, if desired.

The capacity of container 12 is approximately 16 gallons and when filled with water and any additives it is rather heavy thereby necessitating a number of hand holds for rendering the container portable. Specifically, recessed hand holds 30,32, are provided in the side walls 20,22, respectively. Preferably, the recessed hand holds 30,32 in the opposite side walls of the container extend from the rear wall 24 approximately half way to the front wall 26, as shown best in FIG. 5. Additionally, as shown best in FIG. 4, a recessed hand hold 34 is provided in the rear wall 24 of the container.

Figure 8:
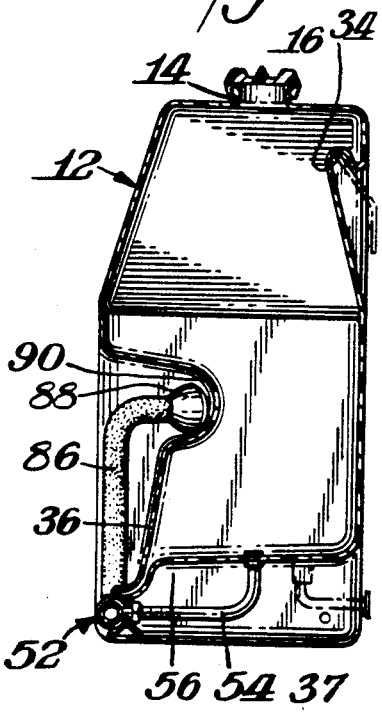
FIG. 8 is a cross-sectional view taken along line 8—8 of FIG. 6.

Container 12 may be attached to a vertical wall at the location of its use. For example, as shown in FIG. 8, an upper wall mounted bracket 35 may engage the recessed rear hand hold 34, and a lower bracket 37 may interfit with the container to prevent it from moving away from the wall. Alternatively, the container 12 can be supported at an appropriate height by a horizontal table top, and it is also contemplated that the container may be mounted on a stand having wheels or casters.

As explained more fully below, the front wall 26 of the container includes a recessed storage cavity 36. Moreover, the side walls 20, 22 include recessed portions 38,40, respectively, and at the lower end of each of these recesses a drain plug 42 is provided for emptying the contents of the container.

Figure 6:
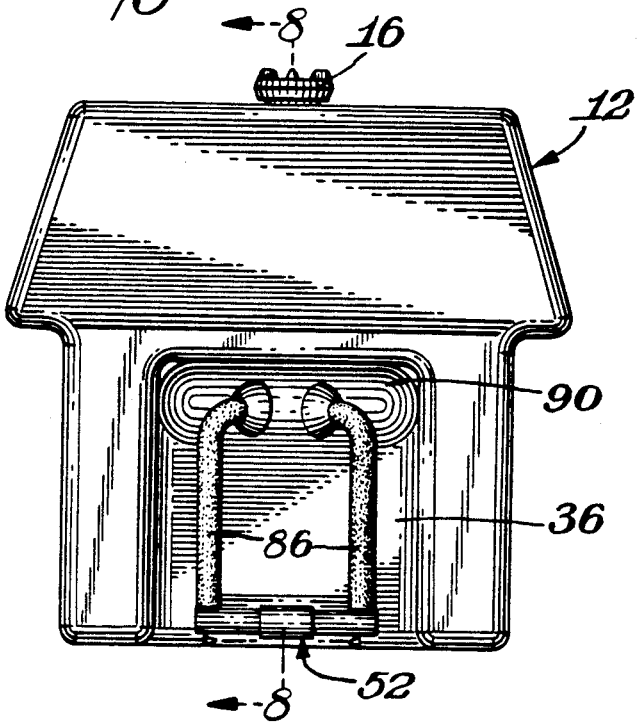
FIG. 6 is a front elevational view of the gravity fed eye/face wash shown in FIGS. 1-5 but with its spray head assembly in its inoperative and stored position.
Figure 7:
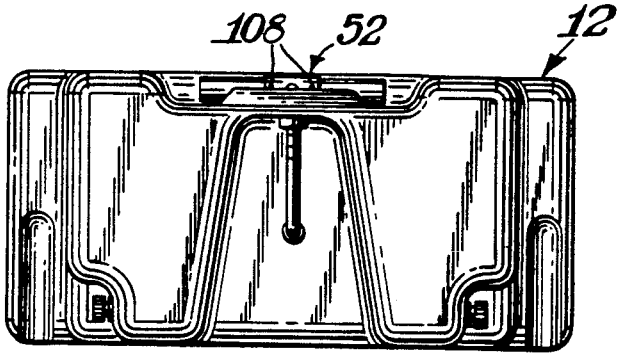
FIG. 7 is a bottom plan view of the gravity fed eye/face wash shown in FIG. 6.

The portable gravity fed eye/face wash 10 also includes a spray head assembly 50 secured to water container 12 within the recessed storage cavity 36 in the front wall 26 of the container. A rotatable valve mechanism 52 is positioned between the water container and the spray head assembly. As explained more fully below, rotatable valve mechanism 52 has open and closed positions approximately 90° apart for regulating water flow from the container to the spray head assembly. A conduit 54 positioned within a bottom wall recess 56 connects the lower end of the container with the valve mechanism. The assembly is shown in its operative position in FIGS. 1–5 where such assembly extends outwardly and away from front wall 26 of the container. Moreover, the spray head assembly may be rotated 90° in an upward direction to its inoperative and stored position, as shown best in FIGS. 6–7, and as explained more fully below.

Spray head assembly 50 includes a pair of spaced apart L-shaped elongate conduit members 58 each having an inner leg 60 connected to valve mechanism 52 and a relatively shorter leg 62 connected to the inner leg at an approximate right angle thereto.

FIGS. 9–12 illustrate the L-shaped elongate members in more detail. A spray head 64 is connected to each of the L-shaped conduit members 58 at the outer end of outer leg 52. A threaded connection 66 is provided to releasably secure the spray head to the L-shaped elongate member. Moreover, each spray head includes a spray head base 68 and a spray head cap 70 both constructed of ABS material. The spray head base is releasably connected to the L-shaped elongate conduit member via threaded connection 66 and the spray head cap is releasably connected to the base in the following manner.

Figures 9, 10, 11, 12, 14, 15, 16:
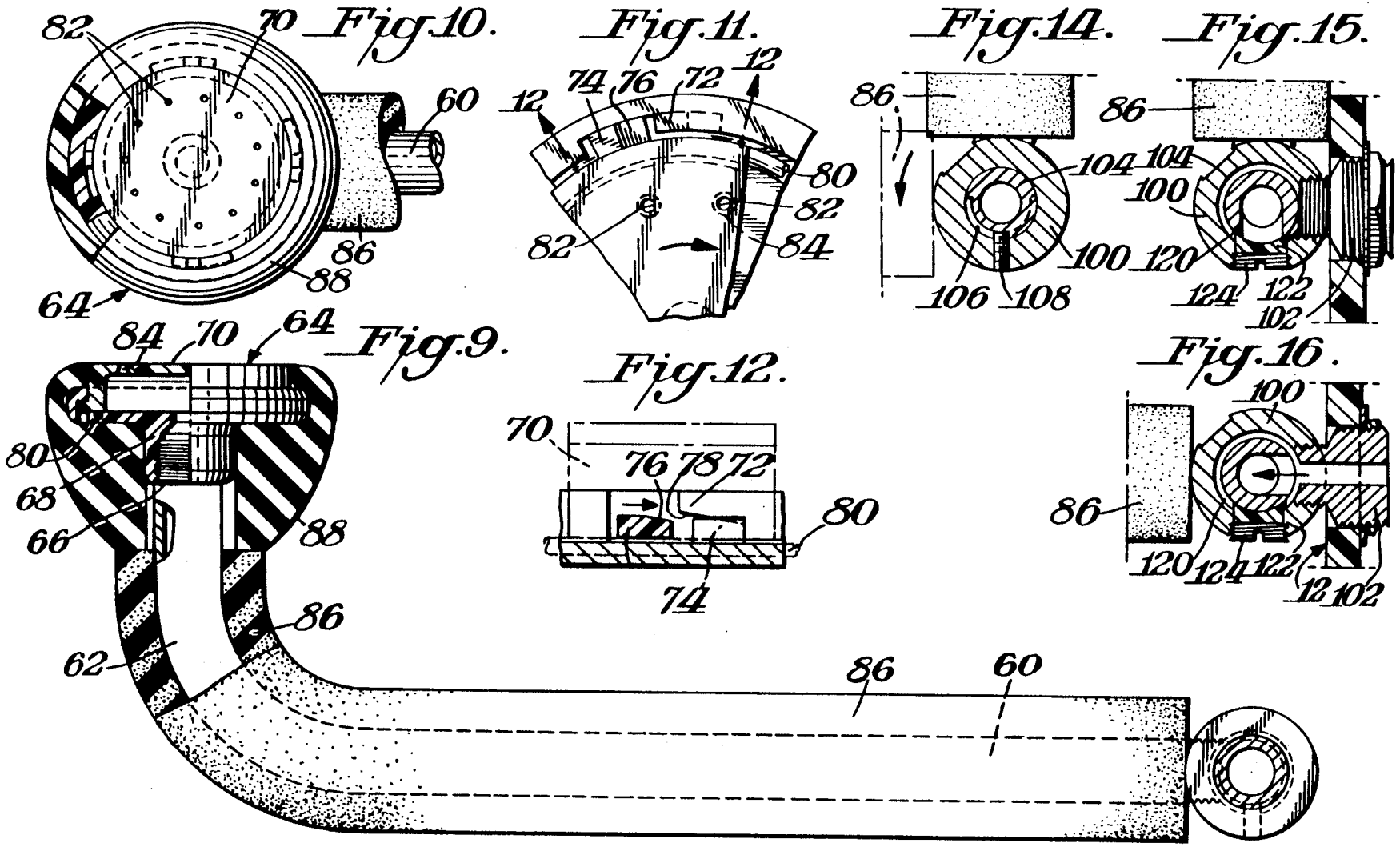
FIG. 9 is an enlarged right side elevational view of the spray head assembly with portions thereof broken away to show interior details.
FIG. 10 is a top plan view of the spray head cap of the spray head assembly shown in FIG. 9.
FIG. 11 is an enlarged partial top plan view of the spray head cap illustrating the connection between the cap and its associated spray head base.
FIG. 12 is a cross-sectional view taken along line 12—12 of FIG. 11.
FIG. 14 is a cross-sectional view taken along line 14—14 of FIG. 13.
FIG. 15 is a cross-sectional view taken along line 15—15 of FIG. 13.
FIG. 16 is a cross-sectional view similar to FIG. 15 but illustrating the spray head assembly in its operative position, as shown in FIG. 1.

As shown best in FIGS. 11 and 12, spray head base 68 includes a plurality of spaced apart undercuts 72 arranged in a circular pattern around the periphery of the base. The spray head cap includes a plurality of equally spaced apart lugs 74 arranged in a similar circular pattern for locking engagement with the undercuts. The upper surface of each lug 74 includes an inclined cam surface 76 and each undercut 72 includes a complimentary inclined cam surface 78. When the spray head base and spray head cap are rotated relative to one another, the lugs 74 are positioned within the undercuts 72 and the cooperating cam surfaces 76,78 force the spray head cap tightly against the spray head base. An O-ring 80 functions to provide sealing engagement between the spray head cap and its associated base.

Spray head cap 70 includes a plurality of openings 82 therein equally spaced apart and arranged in a circular pattern. Eleven openings are provided and a beneficial flow is produced through these openings when the eye/face wash 10 is operational. As shown best in FIG. 9, each of the spray openings 82 comprises a frustoconical passageway 84 with the small end thereof opening in an outward direction.

The L-shaped elongate conduit members of the spray head assembly are covered with a soft rubber-like material which acts as cushioning 86. Similarly, each spray head 64 is covered with a neopreme guard 88 to protect the user from injury.

The recessed storage cavity 36 also includes a rearwardly recessed portion 90 designed to accommodate the outer legs 52 and spray heads 64 when the spray assembly is in its inoperative and stored position. Cavity 36 functions to protect the spray heads from dust and other contaminants when the spray assembly is stored.

Turning now to FIGS. 13–16, valve mechanism 52 includes a valve body 100 fixed to water container 12 by a supply tail piece 102. The supply tail piece is connected to the container as shown in FIG. 16 and the tail piece is connected to the water supply conduit 54 at the bottom of the water container. The front portion of the tail piece is threaded into a suitable opening in the valve body to anchor the body to the container.

A valve spindle 104 is rotatably mounted within the valve body and rotation of the spindle is limited to approximately 90° by a pair of spaced apart arcuate grooves 106 in the spindle and threaded pins 108, each positioned within one of the grooves, as shown in FIG. 14. Each arcuate groove 106 extends over approximately 90° of the outer circumference of the valve spindle and each fixed pin 108 being secured to the fixed valve body 100 limits rotation of the valve spindle to approximately 90°. This 90° movement enables the spray head assembly 50 to move from its operative position shown in FIGS. 1–5 to its inoperative and stored position shown in FIGS. 6–8.

Figure 13:
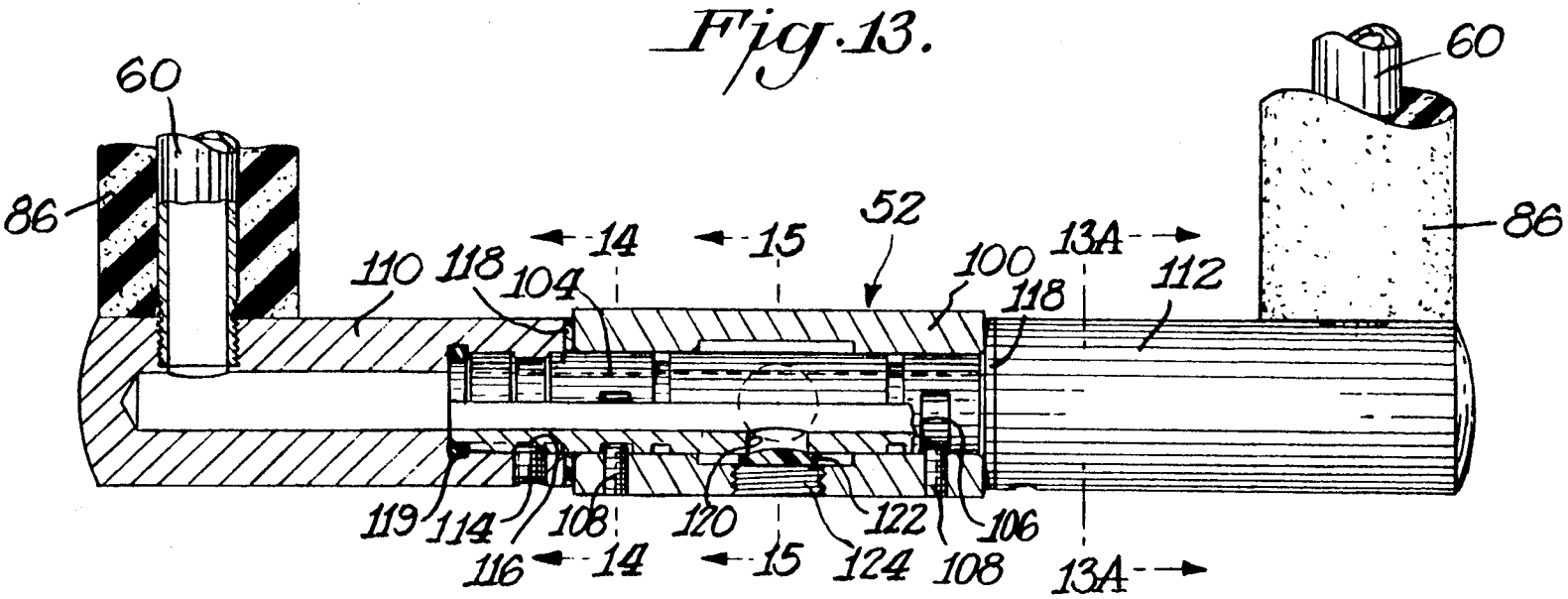
FIG. 13 is an enlarged partial front elevational view of the spray head assembly in its inoperative and stored position with portions thereof broken away to illustrate interior details of the valve spindle.
Figure 13A:
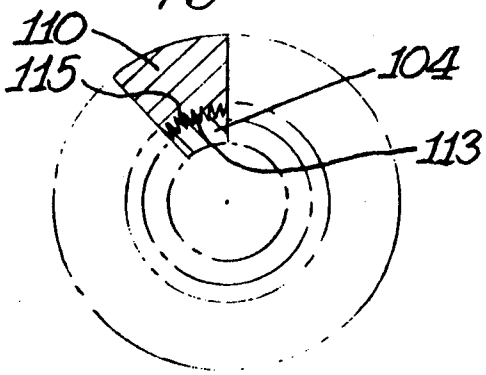
FIG. 13A is a cross-sectional view taken along line 13A—13A of FIG. 13.

Valve mechanism 52 also includes valve outlet ends 110,112 fixed to the ends of the rotatable valve spindle 104 for movement therewith by a splined connection comprising splines 113 on outside portions of the valve spindle and mating grooves 115 on the inside of each valve outlet end, as shown best in FIG. 13A. Approximately sixty equally spaced apart splines are provided on the outside of the spindle to enable fine adjustment of the relative position between the spindle and the valve outlet ends. Repositioning of the valve outlet ends relative to the spindle by shifting one spline produces 6° of adjustment. A locking lug 114 on each valve outlet end is tightened against the valve spindle within an annular groove 116 so that the valve outlet ends cannot be pulled outwardly away from the spindle. Moreover, the inner legs 60 of the L-shaped elongate conduit members 58 are connected to the valve outlet ends 110,112, as shown in FIGS. 9 and 13. Sealing washers 118 are positioned between the valve body and the valve outlet ends, and O-rings 119 are located between the ends of the spindle and the valve outlet ends.

Figure 1:
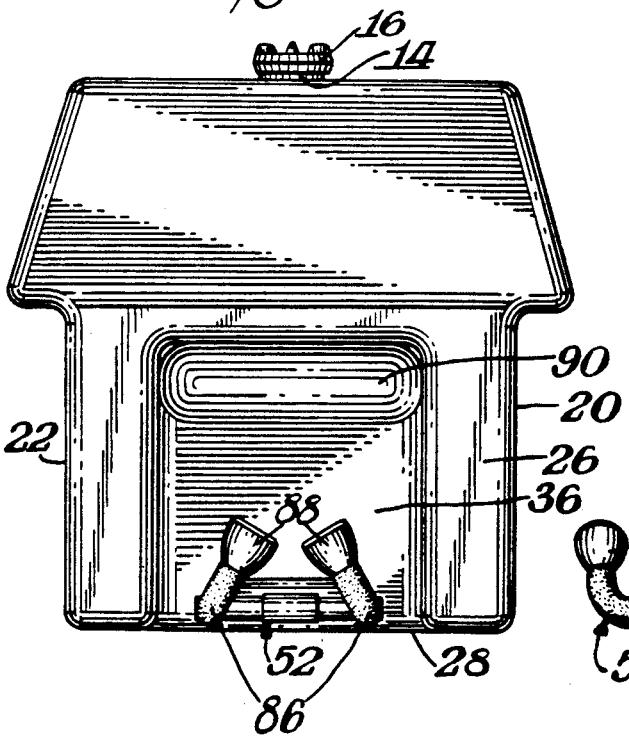
FIG. 1 is a front elevational view of a gravity fed eye/face wash with its spray head assembly in an operative position, according to the present invention.
Figure 2:
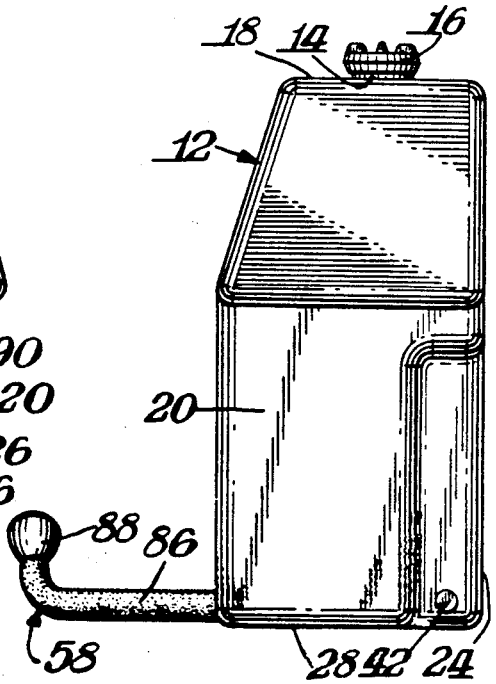
FIG. 2 is a right side elevational view of the gravity fed eye/face wash shown in FIG. 1, the left side elevational view being a mirror image duplicate.
Figure 4:
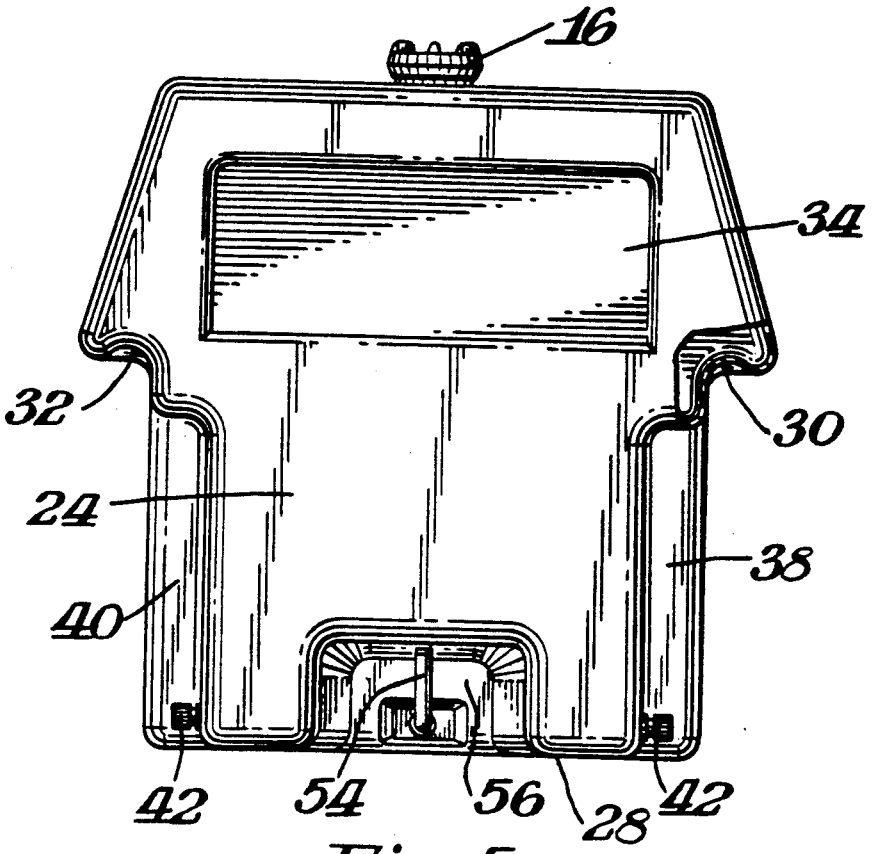
FIG. 4 is a rear elevational view of the gravity fed eye/face wash shown in FIGS. 1-3.
Figure 5:
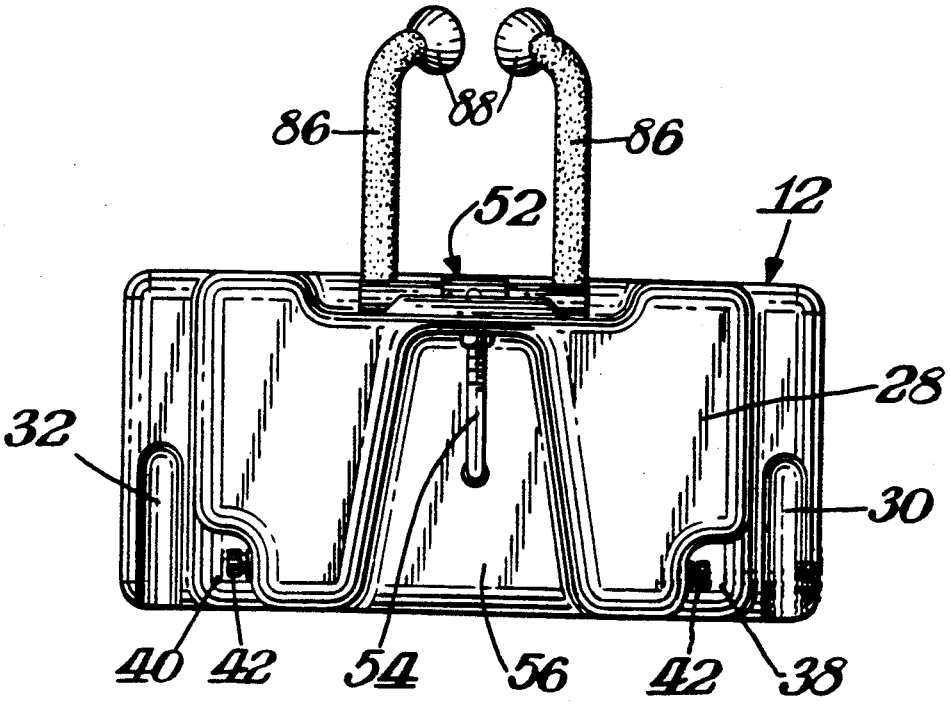
FIG. 5 is a bottom plan view of the gravity fed eye/face wash shown in FIGS. 1-4.

The rotatable spindle includes an opening 120 that communicates with the supply tail piece 102 when the spray head assembly 50 is in its operative position. Water then flows from container 12 through the conduit 54 at the base of the container to the supply tail piece 102 and into the valve spindle through opening 120. Water continues to flow through the spindle into the valve outlet ends 110,112 and into the L-shaped elongate members 58. Water emerges from each spray head 64. Preferably, the outer legs 62 of the L-shaped elongate members 58 extend upwardly and at an angle to each other, as shown in FIG. 1, the included angle being approximately 30°.

Valve body 100 also includes a Teflon packing washer or seal 122 and a plug 124 which enables removal and replacement of the seal when needed. In the inoperative position of the spray head assembly 50 shown in FIGS. 6–8, the inlet opening 120 in the valve spindle is positioned against the seal 122 (FIG. 15) which prevents water from flowing into the valve spindle. In use, movement of the spray head assembly to its operative position automatically starts the flow of water to the spray heads 64. Positioning the eyes and face next to the spray head produces a beneficial flushing action.

A spring washer (not shown) may be positioned between the seal 122 and plug 124 for the purpose of adjusting the frictional engagement between the seal and the valve spindle. A certain amount of friction is desirable for preventing excessive force of the spindle against the limiting pins 108 when the valve assembly is shifted to its operative position: Excessive forces over extended periods could operate to shear these pins.

Figure 18:
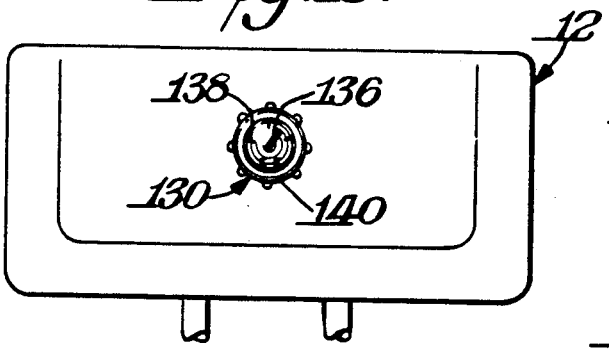
FIG. 18 is a top plan view of the gravity fed eye/face wash of FIG. 17.
Figure 17:
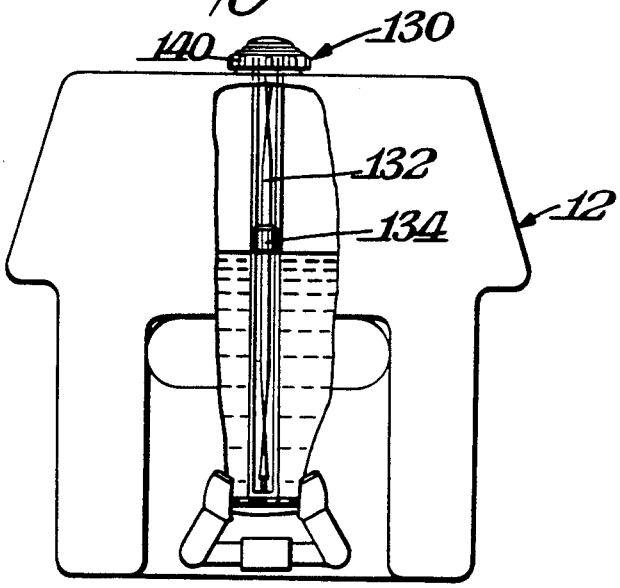
FIG. 17 is a front elevational view of another gravity fed eye/face wash similar to FIG. 1 with portions broken away to show interior details of a fluid level indicator mechanism.

FIGS. 17 and 18 illustrate another feature of the present invention comprising a fluid level indicator 130 which produces a visible indication of the fluid level within the container 12. Specifically, a flat rod 132 with a twist therein extends from the top of the container to the bottom. A float 134 loosely connected to the rod moves up or down depending on the fluid level. As the float moves in a vertical direction, such movement causes the rod to rotate due to its twisted configuration. The upper end of the rod is connected to a pointer 136 and the pointer cooperates with indicia 138 on a fill cap 140 to indicate the fluid level.

Figure 19:
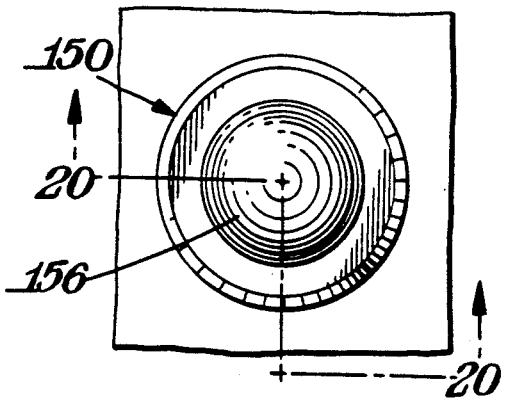
FIG. 19 is a partial top plan view of still another embodiment having a pump for pressurizing eye/face wash fluid.
Figure 20:
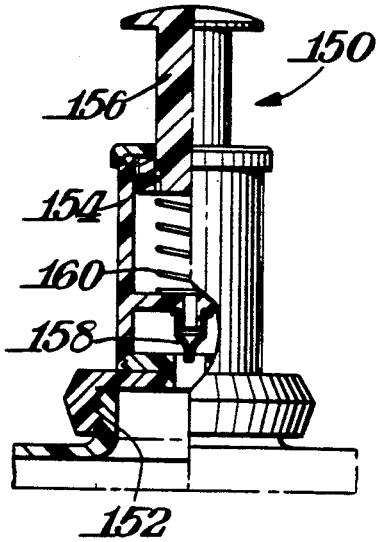
FIG. 20 is a cross-sectional view taken along line 20—20 of FIG. 19.
Figure 21:
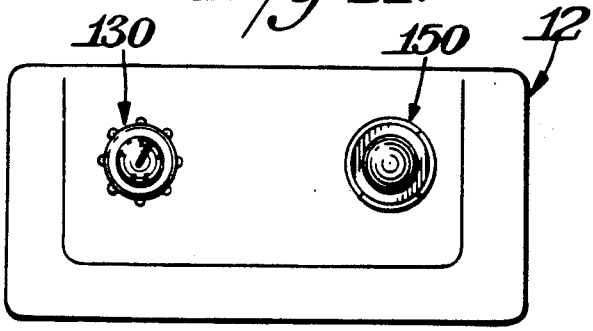
FIG. 21 is a top plan view of a gravity fed eye/face wash having a gravity assist pump and a fluid level indicator mechanism.

FIGS. 19 and 20 illustrate a hand pump 150 connected to the upper end of the container 12 via a threaded connection 152. Manipulation of the pump pressurizes the interior of the container to assist the gravitational forces which produce the desired water flow. Hand pump 150 includes a housing 154 and an operator-plunger 156. When the operator-plunger is pushed in a downward direction air within the housing 154 is forced into the container 12 through a one-way duckbill valve 158. A coil spring 160 within the housing functions to return the operator-plunger to its starting position. The pump is particularly useful when the water level is low.

Figure 22:
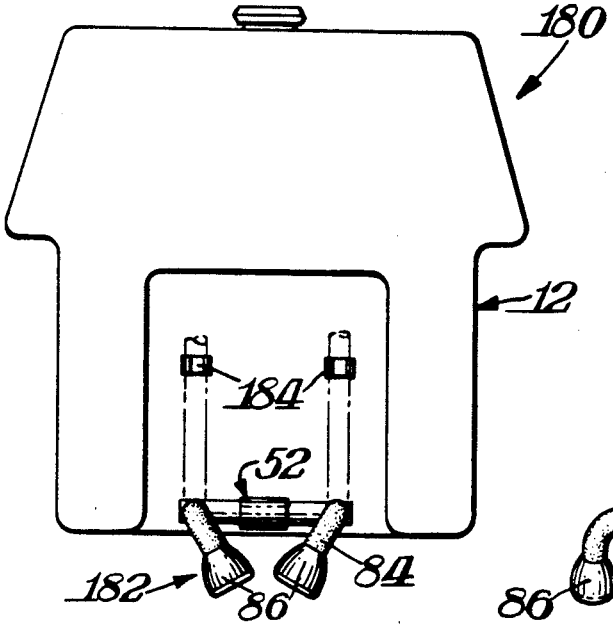
FIG. 22 is a front elevational view of a gravity fed shower, according to the present invention.
Figure 23:
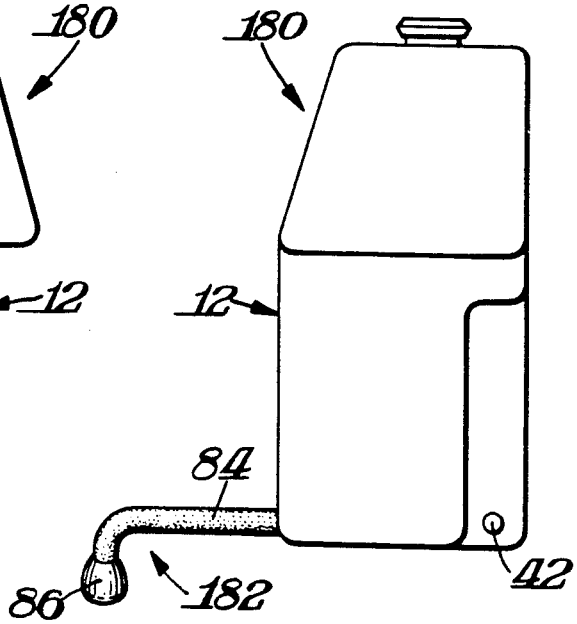
FIG. 23 is a right side elevational view of the gravity fed shower shown in FIG. 22, the left side elevational view being a mirror image duplicate.

FIGS. 22 and 23 illustrate a portable gravity fed shower 180 which is similar in many respects to the eye/face wash 10 discussed above. The only significant difference is that shower 180 includes a spray head assembly 128 which reoriented 180° compared to the spray head assembly 50 of eye/face wash 10. Otherwise, these devices are the same. Brackets 184 may be provided in the storage cavity 36 to hold the spray head 182 in its inoperative position.

Figure 24:
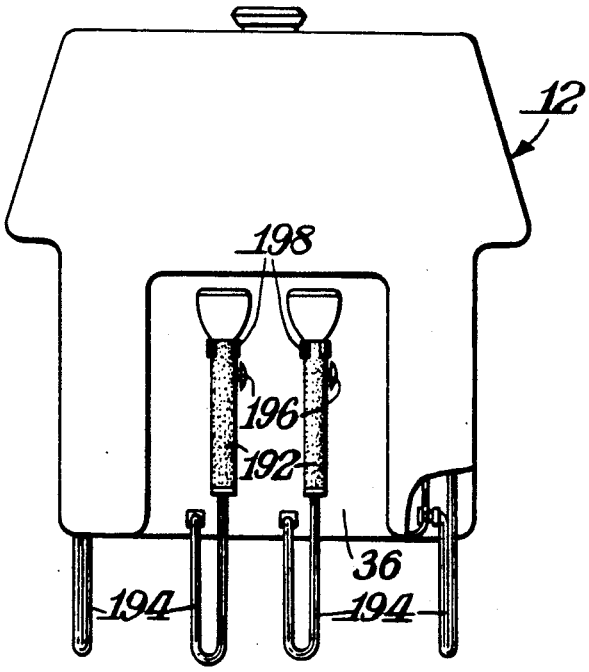
FIG. 24 is a front elevational view of a gravity fed wash with hand held spray heads.
Figure 25:
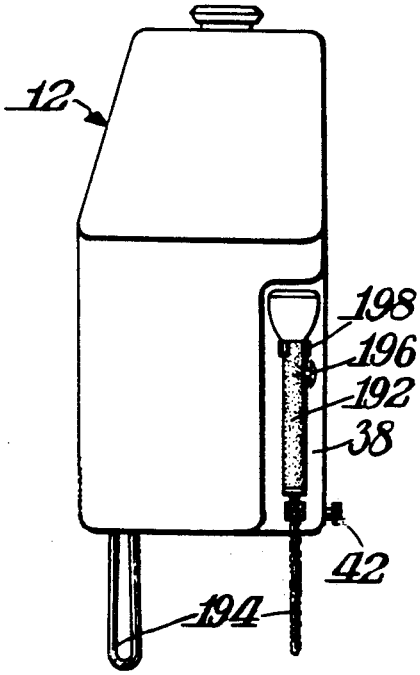
FIG. 25 is a right side elevational view of the gravity fed wash of FIG. 26, the left side elevational view being a mirror image duplicate.

FIGS. 24 and 25 illustrate a portable gravity fed wash 190 including a water container 12 similar to the container 12 of eye/face wash 10. However, in place of a spray head assembly the wash device 190 includes a plurality of hand held spray heads 192 connected to the container by flexible tubing 194. A suitable operator 196 on hand held spray head controls the flow of water therefrom. Depressing the operator opens a valve (not shown) whereby water flows to and through the spray head. When the operator is released, water flow is terminated. Brackets 198 are provided to maintain the spray heads in a stored condition. Several brackets may be located in the storage cavity 36 while others are positioned in the side recesses 38,40.

What is claimed is:

1. A portable gravity fed eye/face wash comprising a water container having a fill opening and a closure cap at an upper end of the container, a recessed storage cavity on a front face of the container, a spray head assembly secured to the water container within the recessed storage cavity, a rotatable valve mechanism between the water container and the spray head assembly, the rotatable valve mechanism having open and closed positions approximately ninety degrees apart for regulating water flow from the container to the spray head assembly, the spray head assembly including a pair of spaced apart L-shaped elongate conduit members each having an inner leg generally parallel to the other inner leg, one end of each inner leg being connected to the valve mechanism, each L-shaped elongate conduit member also having a relatively shorter leg connected to the inner leg at an approximate right angle thereto, the shorter legs being upwardly disposed angled toward one another, a spray head connected to each of the L-shaped elongate conduit members at outer ends of the shorter legs, each spray head having a plurality of openings therein, and the spray head assembly having an operative position with the L-shaped elongate conduit members extending outwardly away from the container, the valve mechanism open and water flowing from the spray heads, and an inoperative position with the L-shaped elongate conduit members upwardly oriented into the storage cavity, the valve mechanism closed and no water flowing from the spray heads, and the water container having opposite side walls, a rear wall and a front wall, and recessed hand holds in the side walls of the container.

2. A portable gravity fed eye/face wash as in claim 1 wherein the recessed hand holds in the opposite side walls of the container extend from the rear wall approximately half way to the front wall.

3. A portable gravity fed eye/face wash as in claim 1 including a recessed hand hold in the rear wall of the water container.

4. A portable gravity fed eye/face wash as in claim 1 wherein the recessed storage cavity in the front wall of the container includes a rearwardly recessed portion constructed and arranged to receive the outer legs of the L-shaped elongate conduit members and the spray heads connected thereto when the spray head assembly is upwardly oriented about the valve mechanism into the storage cavity to its inoperative position.

5. A portable gravity fed eye/face wash as in claim 1 wherein water container includes at least one drain plug.

6. A portable gravity fed eye/face wash as in claim 1 wherein the spray head at the end of each of the L-shaped elongate conduit members comprises a spray head base releasably connected to the shorter leg and a spray head cap releasably connected to the pray head base.

7. A portable gravity fed eye/face wash as in claim 6 wherein the spray head base includes a plurality of spaced apart undercuts arranged in a circular pattern, and wherein the spray head cap includes a plurality of equally spaced apart lugs arranged in a similar circular pattern for locking engagement with the undercuts.

8. A portable gravity fed eye/face wash as in claim 7 wherein the lugs and undercuts include cooperating inclined surfaces in engagement with one another.

9. A portable gravity fed eye/face wash as in claim 6 wherein each spray cap includes the plurality of spray openings and wherein the openings are equally spaced apart and arranged in a circular pattern.

10. A portable gravity fed eye/face wash as in claim 9 wherein each of the spray openings comprises a frusto-conical passageway with a small end thereof opening in an outward direction.

11. A portable gravity fed eye/face wash as in claim 1 wherein the valve mechanism includes a valve body fixed to the water container, a valve spindle rotatably mounted within the valve body, valve outlet ends secured to the ends of the valve spindle for rotation therewith, the valve outlet ends being connected to the inner legs of the L-shaped elongate conduit members, a water inlet in the valve body, and an opening in the valve spindle in alignment with the water inlet in the valve body when the spray head assembly is in its operative position and out of alignment with the water inlet in the valve body when the spray head assembly is in its inoperative and stored position.

12. A portable gravity fed eye/face wash as in claim 11 including stop mean connected between the valve body and the valve spindle limiting rotation of the spindle within the body to approximately ninety degrees.

13. A portable gravity fed eye/face wash as in claim 11 including a seal secured to the valve body for sealing the opening in the valve spindle when the spray head assembly is in its inoperative and stored position.

14. A portable gravity fed eye/face wash as in claim 1 including a fluid level indicator in the water container for determining and indicating the level of water in the container.

15. A portable gravity fed eye/face wash comprising a water container having a fill opening and a closure cap at an upper end of the container, a recessed storage cavity on a front face of the container, a spray head assembly secured to the water container with the recessed storage cavity, a rotatable valve mechanism between the water container and the spray head assembly, the rotatable valve mechanism having open and closed positions approximately ninety degrees apart for regulating water flow from the container to the spray head assembly, the spray head assembly including a pair of spaced apart L-shaped elongate conduit members each having an inner leg generally parallel to the other inner leg, one end of each inner leg being connected to the valve mechanism, each L-shaped elongate conduit member also having a relatively shorter leg connected to the inner leg at an approximate right angle thereto, the shorter legs being upwardly disposed angled toward one another, a spray head connected to each of the L-shaped elongate conduit members at outer ends of the shorter legs, each spray head having a plurality of openings therein, and the spray had assembly having an operative position with the L-shaped elongate conduit members extending outwardly away from the container, the valve mechanism open and water flowing from the spray heads, and an inoperative position with the L-shaped elongate conduit members upwardly oriented into the storage cavity, the valve mechanism closed and no water flowing from the spray heads, and a soft rubber-like material covering the L-shaped elongate conduit members and the spray heads.

16. A portable gravity fed eye/face wash comprising a water container having a fill opening and a closure cap at an upper end of the container, a recessed storage cavity on a front face of the container, a spray head assembly secured to the water container within the recessed storage cavity, a rotatable valve mechanism between the water container and the spray head assembly, the rotatable valve mechanism having open and closed positions approximately ninety degrees apart for regulating water flow from the container to the spray head assembly, the spray head assembly including a pair of spaced apart L-shaped elongate conduit members each having an inner leg generally parallel to the other inner leg, one end of each inner leg being connected to the valve mechanism each L-shaped elongate conduit member also having a relatively shorter leg connected to the inner leg at an approximate right angle thereto, the shorter legs being upwardly disposed angled toward one another, a spray head connected to each of the L-shaped elongate conduit members at outer ends of the shorter legs, each spray head having a plurality of openings therein, and the spray had assembly having an operative position with the L-shaped elongate conduit members extending outwardly away from the container, the valve mechanism open and water flowing from the spray heads, and an inoperative position with the L-shaped elongate conduit members upwardly oriented into the storage cavity, the valve mechanism closed and no water flowing from the spray heads, and an air pump connected to the water container for pressurizing the container to assist gravitational forces in flowing water to the spray head assembly when that assembly is in its operative position.

17. A portable gravity fed eye/face wash as in claim 16 wherein the water container has opposite side walls, a rear wall and a front wall, and recessed hand holds in the side walls of the container.

* * * * *

UNITED STATES PATENT AND TRADEMARK OFFICE

CERTIFICATE OF CORRECTION

PATENT NO. : 5,216,765

DATED : June 8, 1993

INVENTOR(S) : Graham H. Paterson et al

It is certified that error appears in the above-indentified patent and that said Letters Patent is hereby corrected as shown below:

Column 8, line 46 (claim 6, line 5), "pray" should read --spray--.

Column 9, line 26 (claim 15, line 5), "with" should read --within--.

Signed and Sealed this

Eleventh Day of January, 1994

Bruce Lehman

*Attest:*

BRUCE LEHMAN

*Attesting Officer*

*Commissioner of Patents and Trademarks*